US008305056B2

(12) United States Patent
Wadhwa

(10) Patent No.: US 8,305,056 B2
(45) Date of Patent: Nov. 6, 2012

(54) LOW DROP-OUT VOLTAGE REGULATOR WITH WIDE BANDWIDTH POWER SUPPLY REJECTION RATIO

(75) Inventor: Sameer Wadhwa, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 723 days.

(21) Appl. No.: 12/330,926

(22) Filed: Dec. 9, 2008

(65) Prior Publication Data

US 2010/0141223 A1 Jun. 10, 2010

(51) Int. Cl.
*G05F 1/00* (2006.01)

(52) U.S. Cl. ..... 323/270; 323/280

(58) Field of Classification Search ..... 323/273–281, 323/270, 226

See application file for complete search history.

(56) References Cited

U.S. PATENT DOCUMENTS

| | | | | |
|---|---|---|---|---|
| 5,168,209 | A | 12/1992 | Thiel | |
| 6,765,374 | B1 * | 7/2004 | Yang et al. | 323/280 |
| 7,170,264 | B1 | 1/2007 | Galinski | |
| 7,391,258 | B2 * | 6/2008 | Frederiksen et al. | 330/10 |
| 2006/0028189 | A1 | 2/2006 | Akita | |
| 2006/0132107 | A1 | 6/2006 | Sicard | |
| 2007/0159146 | A1 | 7/2007 | Mandal | |
| 2007/0210779 | A1 * | 9/2007 | Itoh | 323/284 |

FOREIGN PATENT DOCUMENTS

WO WO2006083490 8/2006

OTHER PUBLICATIONS

Sidiropoulos, S., et al., Adaptive Bandwidth DLLs and PLLs Using Regulated Supply CMOS Buffers, 2000 Symposium on VLSI Circuits Digest of Technical Papers, Apr. 2000, pp. 124-127.

Gupta, V. et. al, A Low Dropout, CMOS Regulator With High PSR Over Wideband Frequencies, IEEE International Symposium on Circuits and Systems, May 2005, vol. 5, pp. 4245-4248.

Gupta, V. et. al., A 5mA 0.6μm CMOS Miller-Compensated LDO Regulator with -27dB Worst Case Power-Supply Rejection Using 60pF On-Chip Capacitance, 2007 IEEE International Solid-State Circuits Conference, Feb. 2007, Session 29, Analog and Power Management Techniques 29.2, Digest of Technical Papers, pp. 520-521.

Alon, E., et. al., Replica Compensated Linear Regulators for Supply-Regulated Phase-Locked Loops, IEEE Journal of Solid-State Circuits, Feb. 2006, pp. 413-424, vol. 41, No. 2.

Alon, E., et al., Integrated Regulation for Energy-Efficient Digital Circuits, IEEE Journal of Solid-State Circuits, Aug. 2008, pp. 1795-1807, vol. 43, No. 8.

(Continued)

*Primary Examiner* — Harry Behm
*Assistant Examiner* — Matthew Grubb
(74) *Attorney, Agent, or Firm* — Eric Ho

(57) ABSTRACT

A low drop-out (LDO) voltage regulator with a wide bandwidth power supply rejection ratio (PSRR) is described. In one aspect, the LDO voltage regulator includes two individual voltage regulator circuit stages. A first stage voltage regulator circuit output is at an intermediate voltage (VINT) between an input supply voltage (VDD) and a final regulated output voltage (VREG). A second stage voltage regulator circuit output is at the final regulated output voltage (VREG) and is optimized for noise-sensitive analog circuits across a wide operating bandwidth. The first stage voltage regulator circuit has a zero frequency while the second stage voltage regulator circuit has a matching pole frequency to minimize the AC response from VDD to VREG across all frequencies.

40 Claims, 7 Drawing Sheets

OTHER PUBLICATIONS

International Search Report and Written Opinion—PCT/US2009/067359, International Search Authority—European Patent Office—Nov. 5, 2010.

Akira Yamazaki, et al., "A Frequency Compensation Technique for Variable Output Low Dropout Regulators" Circuits and Systems, 2006. APCCAS 2006. IEEE Asia Pacific Conference on, IEEE, Piscataway, NJ, USA, Dec. 1, 2006, pp. 1595-1598, XP031071154 ISBN: 978-1-4244-0387-5 the whole document.

Lima F, et al., "Embedded cmos distributed voltage regulator for large core loads" European Solid-State Circuits, 2003. ESSCIRC '03. Conference on Sep. 16-18, 2003, Piscataway, NJ, USA,IEEE LNKDDOI: 10.1109/ESSCIRC.2003.1257187, Sep. 16, 2003, pp. 521-524, XP010677218 ISBN: 978-0-7803-7995-4 the whole document.

* cited by examiner

Example FIG. 4 Supply Rejection VDD to VINT, VINT to VREG, VDD to VREG

LOW DROP-OUT VOLTAGE REGULATOR WITH WIDE BANDWIDTH POWER SUPPLY REJECTION RATIO

TECHNICAL FIELD

The present disclosure relates generally to the field of integrated circuits, and more specifically to low drop-out (LDO) voltage regulators for noise-sensitive individual analog circuits, such as phase-lock loops (PLLs) and other embedded analog cores within a system-on-chip (SoC).

BACKGROUND

Embedded analog circuits such as phase lock loops (PLLs), voltage controlled oscillators (VCOs), digital to analog converters (DACs), analog to digital converters (ADCs), and radio frequency (RF) transceivers rely on a wide bandwidth noise-free power supply voltages to meet phase-noise, timing-jitter, spurious-free dynamic range, and low-noise figure requirements in individual blocks.

FIG. 1 is an example integrated circuit die block diagram of a SoC 100 utilizing multiple LDOs 110 connected to multiple circuit blocks 120 tied to a common externally supplied voltage VDD.

As more SoC designs progress toward embedding more analog circuits along with digital processors in the same silicon die, it is desirable to include independent low-noise voltage regulators for each embedded analog core to improve circuit isolation.

Low Drop-Out (LDO) voltage regulators have been traditionally used to meet this requirement. However, it is a design challenge to implement a wide bandwidth power supply rejection ratio (PSRR) LDO voltage regulator using only on-chip components.

Traditionally phase lock loops (PLLs) and embedded analog cores use independent power-supply bumps to get a clean power supply connection. The number of power-supply bumps and silicon die bond pads increases as multiple PLLs and embedded analog cores are integrated into a system-on-chip (SoC).

The power-supply bumps refer to a solder ball connection between a packaged integrated circuit (IC) and the main application circuit board. By incorporating LDO voltage regulators on the IC, the number of power-supply and ground connections can be minimized, thereby reducing the packaged IC pin count, chip and main application circuit board routing complexity.

FIG. 2 is a schematic diagram of a known single-stage low drop-out (LDO) voltage regulator. A typical single stage LDO voltage regulator 200, as shown, may be implemented using an error amplifier circuit 202 driving a common-source P-channel metal oxide semiconductor (PMOS) device 204. PMOS device 204 has a decoupling capacitor (CL) 205 coupled at the drain D of PMOS device 204 to suppress power-supply noise leakage from an input voltage VDD. At the drain D of PMOS device 204 is an output node VREG. PMOS device 204 is usually large (in terms of integrated circuit die area) to maintain the voltage drop low across PMOS device 204 (VDD-VREG). Node VREG is also connected to an integrated circuit (IC) load 208. IC load 208 includes the decoupling capacitor (CL) 205 which is in parallel with a resistive load (RL) 209 and a current device (IL) 210.

The configuration of PMOS device 204 and IC load 208 results in two closely-spaced poles that require compensation for stability. In general, a Miller-compensation capacitor (Cc) 206 is used to realize a dominant pole at gate G of PMOS device 204. However, the Miller-compensation capacitor (Cc) 206 results in a zero in the transfer function between the supply voltage (VDD) to LDO voltage regulator output voltage (VREG) (herein after referred to the "supply-to-output transfer function"). A zero in the supply-to-output transfer function compromises the power supply rejection ratio (PSRR) at frequencies above the stated zero frequency.

A reference voltage VREF is provided on the inverting terminal 211 of the error amplifier circuit 202. The output voltage from the error amplifier circuit 202 is denoted as Vout. A feedback loop extends from the VREG node to the non-inverting terminal 212 of the error amplifier circuit 202. VREF is typically provided by a precision band-gap reference and is equal to the desired VREG voltage. Alternatively, VREF may be a programmable voltage by using a band-gap reference in conjunction with a digital-to-analog converter to set the desired VREG voltage.

FIG. 3 is an example graph of the wide bandwidth supply rejection from VDD (input) to VREG (output) vs. Frequency (Hz) for the single-stage LDO voltage regulator shown in FIG. 2.

As shown in FIG. 3, the supply rejection from VDD to VREG vs. Frequency (Hz), for LDO voltage regulator 200 of FIG. 2, may be compromised by the zero frequency location. The rejection is limited to −40 dB at low frequencies (less than 400 kHz in this example) and worsens from approximately 1 MHz to 10 GHz as a result of the zero in the transfer function. The worst case supply rejection is approximately −15 dB at 100 MHz in this example. In the presence of wide bandwidth noise on the VDD source voltage, an LDO voltage regulator, with such poor PSRR, will compromise analog circuit block performance in PLLs, VCOs, DACs, ADCs, and RF transceivers utilizing a suitable VREG output voltage.

There is a need therefore for a low drop-out (LDO) voltage regulator integrated circuit with improved wide bandwidth power supply rejection ratio (PSRR).

SUMMARY

A low drop-out (LDO) voltage regulator with a wide bandwidth power supply rejection ratio (PSRR) is described. In one aspect, the LDO voltage regulator includes two individual voltage regulator circuit stages. A first stage voltage regulator circuit output is at an intermediate voltage (VINT) between an input supply voltage (VDD) and a final regulated output voltage (VREG). A second stage voltage regulator circuit output is at the final regulated output voltage (VREG) and is optimized for noise-sensitive analog circuits across a wide operating bandwidth. The first stage voltage regulator circuit has a zero frequency while the second stage voltage regulator circuit has a matching pole frequency to minimize the AC response from VDD to VREG across all frequencies.

Figure 1:
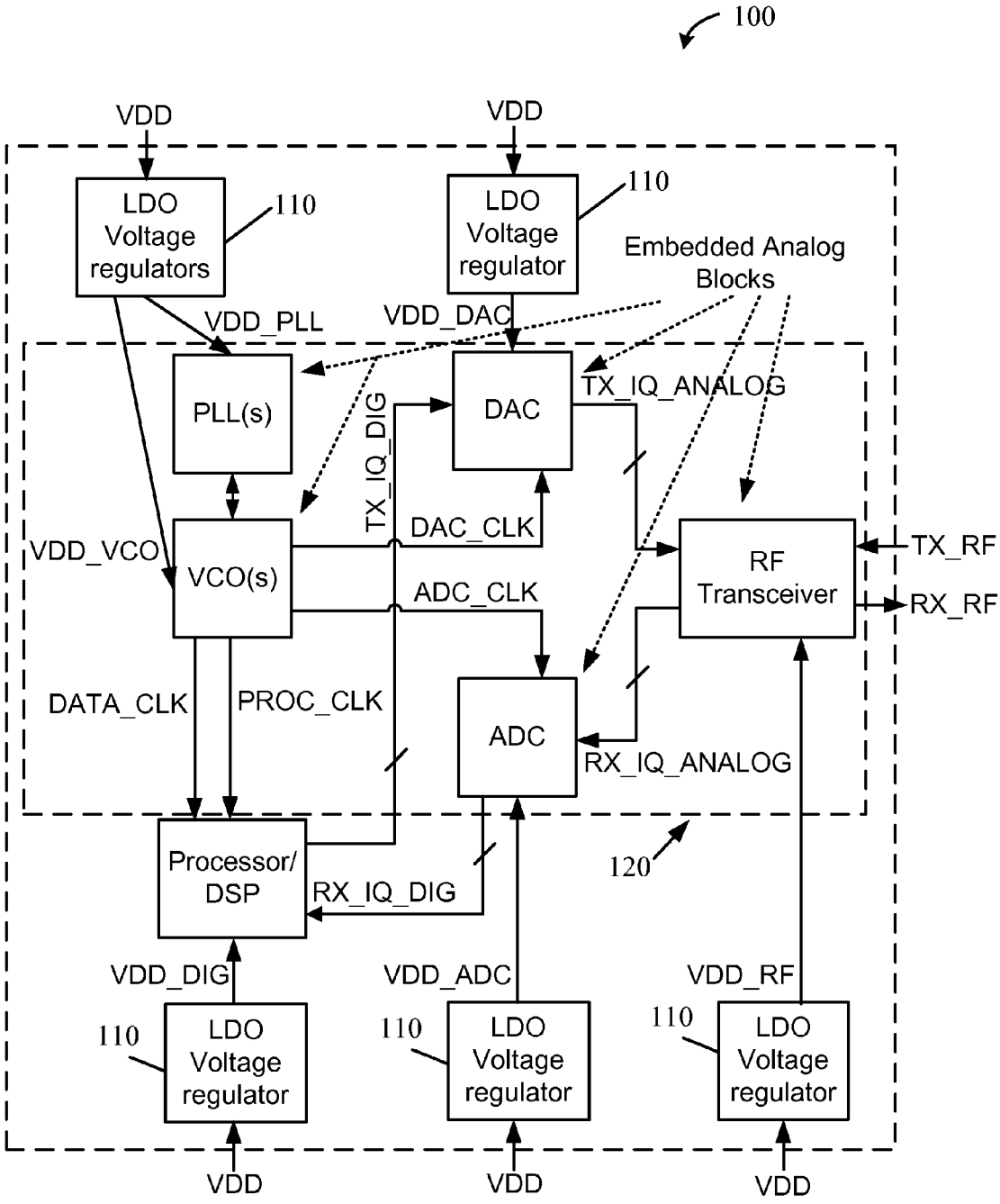
FIG. 1 is an example integrated circuit die block diagram with LDOs for multiple circuit blocks tied to a common externally supplied voltage, VDD.
Figure 2:
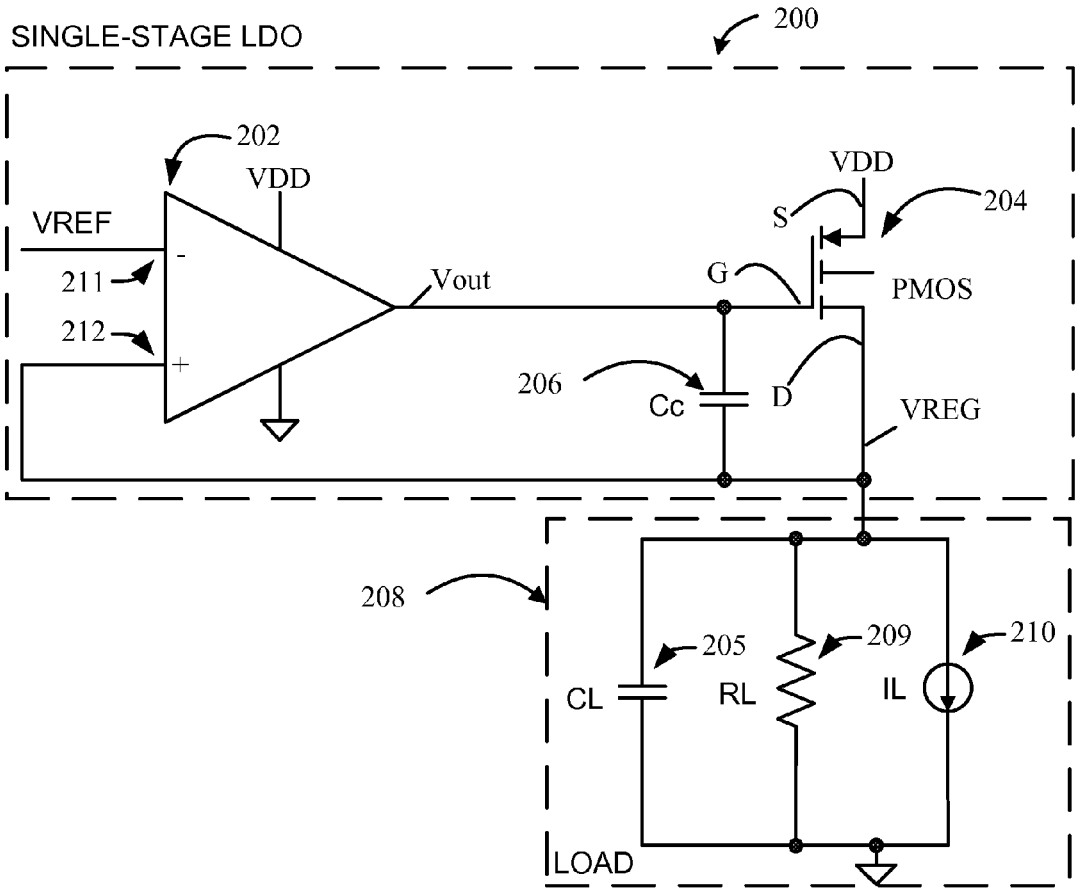
FIG. 2 Prior Art
FIG. 2 is a schematic diagram of a conventional single-stage low drop-out (LDO) voltage regulator.

To facilitate understanding, identical reference numerals have been used where possible to designate identical elements that are common to the figures, except that suffixes may be added, when appropriate, to differentiate such elements. The images in the drawings are simplified for illustrative purposes and are not necessarily depicted to scale.

The appended drawings illustrate exemplary configurations of the disclosure and, as such, should not be considered as limiting the scope of the disclosure that may admit to other equally effective configurations. Correspondingly, it has been contemplated that features of some configurations may be beneficially incorporated in other configurations without further recitation.

DETAILED DESCRIPTION

The word "exemplary" is used herein to mean "serving as an example, instance, or illustration." Any embodiment or design described herein as "exemplary" is not necessarily to be construed as preferred or advantageous over other embodiments or designs.

The wide bandwidth power supply rejection ratio (PSRR) low drop-out (LDO) voltage regulator generates a clean voltage supply for noise-sensitive individual analog circuits, such as phase lock loops (PLLs), voltage controlled oscillators (VCOs), reference current generator for high-speed digital to analog converters (DACs), reference band-gap voltage generator for high-speed analog to digital converters (ADCs), and other wide-bandwidth analog cores. Utilizing individual wide bandwidth PSRR LDO voltage regulators for separate analog circuit blocks in a SoC allows package power-supply bumps to be shared between multiple PLLs and other analog embedded cores; thereby reducing the number of package power supply-bumps required for noise-sensitive analog circuits.

Figure 4:
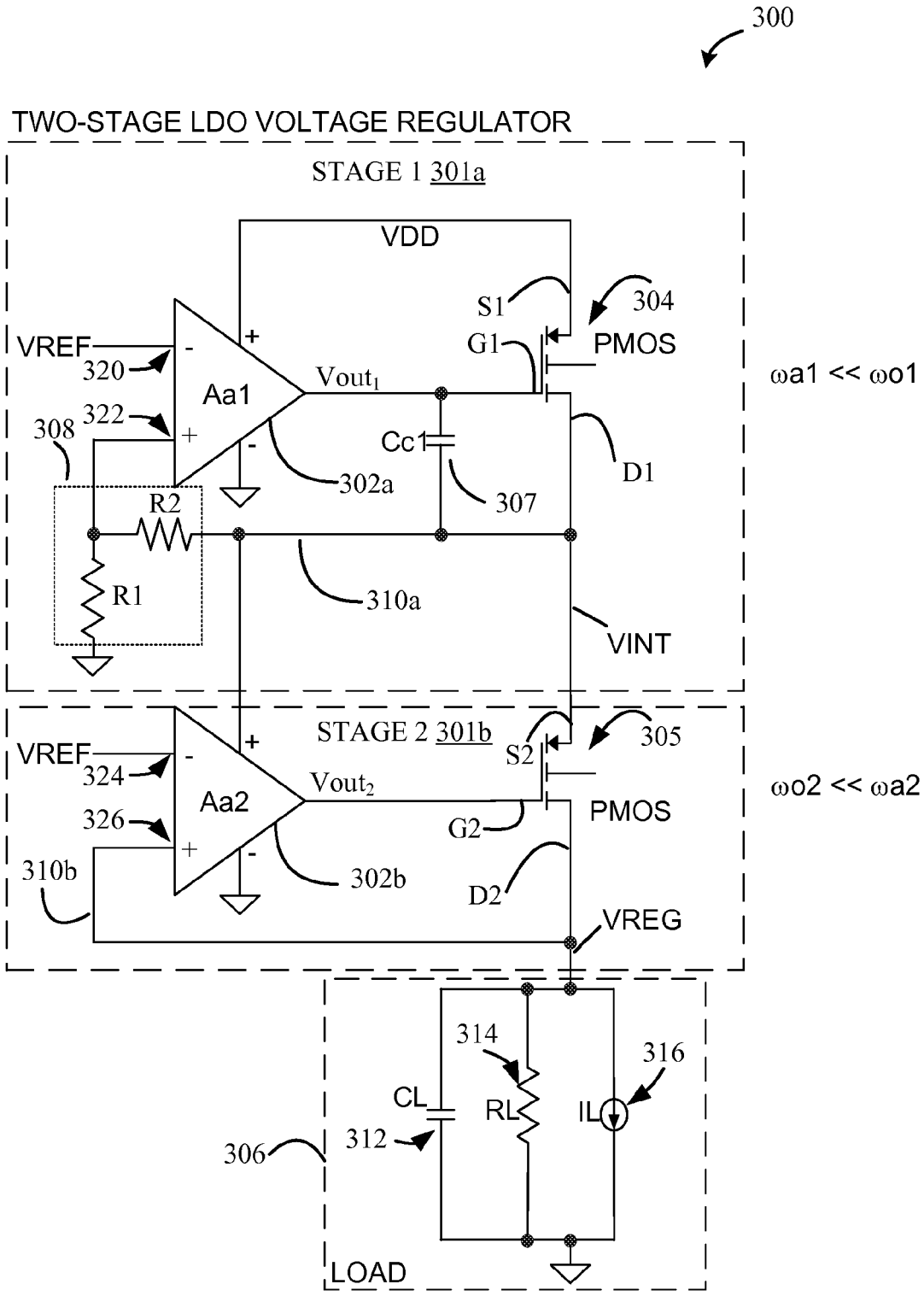
FIG. 4 is a schematic diagram of a two-stage, wide bandwidth, power supply rejection ratio LDO voltage regulator in accordance with a preferred embodiment.

FIG. 4 is a schematic diagram of a two-stage, wide bandwidth, power supply rejection ratio LDO voltage regulator 300 in accordance with a preferred embodiment.

LDO voltage regulator 300 functions to decouple the dominant zero from the dominant pole in the supply-to-output transfer function. LDO voltage regulator 300 includes a first stage voltage regulator circuit 301*a* and a second stage voltage regulator circuit 301*b*. First stage voltage regulator circuit 301*a* is a wide bandwidth stage and has an output gain that is higher than that of second stage voltage regulator circuit 301*b*. Second stage voltage regulator circuit 302*b* is a narrow bandwidth stage. First stage voltage regulator circuit 301*a* and second stage voltage regulator circuit 301*b* include a first-stage error amplifier circuit 302*a* and a second-stage error amplifier circuit 302*b*, respectively. The outputs of each of the first-stage error amplifier circuit 302*a* and second-stage error amplifier circuit 302*b* are coupled to the drains of PMOS devices 304 and 305, respectively. LDO voltage regulator 300 as configured has pole-zero cancellation in the supply-to-output transfer function resulting in a wide-bandwidth PSRR, as shall be explained in greater detail below.

First stage voltage regulator circuit 301*a* further includes regulator loop 310*a* which is configured to be approximately 10 times wider in frequency bandwidth than that of regulator loop 310*b* in second stage voltage regulator circuit 301*b*. Regulator loops 310*a* and 310*b* have little to no effect on settling behavior of the each other.

Additionally, the supply-to-output transfer function dominant pole of second stage voltage regulator circuit 301*b* and the supply-to-output transfer function dominant zero of first stage voltage regulator circuit 301*a* are placed on top of each other (at the same frequency) to achieve a wide bandwidth PSRR. The supply-to-output transfer function dominant zero of the first stage voltage regulator circuit 301*a* is created by a Miller-compensation capacitor (Cc1) 307.

First stage voltage regulator circuit 301*a* has a supply voltage VDD that is regulated down to an intermediate voltage VINT. VINT is regulated down to a final voltage VREG at the output of second stage voltage regulator circuit 301*b*. Since the intermediate voltage VINT provides a low-impedance source node, the output of the first-stage error amplifier circuit 302*a* in the first stage voltage regulator circuit 301*a* forms the dominant pole in the loop transfer function.

A low-impedance on node VINT helps place the dominant pole in the loop transfer function at a high frequency and achieve a wide-band design. In the supply-to-output transfer function for the first stage voltage regulator circuit, this is equivalent to pushing the dominant zero, created by the Miller compensation capacitor (Cc1) 307, further out in frequency. Furthermore, the low-impedance node at the intermediate voltage VINT also provides additional PSRR between VDD and VINT.

In the presently shown embodiment, first stage voltage regulator circuit 301*a* and second stage voltage regulator circuit 301*b* include individual one-stage error amplifier circuits. Second stage voltage regulator circuit 301*b* is designed such that node VREG forms the dominant pole of loop transfer function. In order to ensure regulator loop stability, the second-stage error amplifier circuit 302*b* is designed for a moderate to low gain.

Each stage voltage regulator circuit 301*a* and 301*b* of the two-stage LDO voltage regulator 300 is implemented using a corresponding error amplifier circuit 302*a* or 302*b* driving a common-source PMOS device 304 or 305, at the output stage, of the respective error amplifier circuit, as shown in FIG. 4.

PMOS device 304 includes drain D1, gate G1 and source S1. PMOS device 305 similarly has a drain D2, gate G2 and source S2. PMOS device 305 is further coupled to decoupling capacitor (CL) 312 at the drain D2 to suppress LDO voltage regulator output noise at higher frequencies and to provide compensation by forming the dominant pole in loop transfer function. Node VREG sits between the drain D2 and output load 306. Output load 306 includes decoupling capacitor (CL) 312 which is in parallel with resistive load (RL) 314 and current device (IL) 316, the latter representing the load current of one or more active analog core circuits (PLL, VCO, DAC, ADC, etc).

A reference voltage VREF is provided on the inverting terminal 320 of the error amplifier circuit 302*a*. The output voltage from the error amplifier circuit 302*a* is denoted as $Vout_1$. A feedback loop 310*a* of first stage voltage regulator circuit 301*a* extends from node VINT to the non-inverting input 322 of error amplifier circuit 302*a* with resistor divider circuit 308 composed of R2 and R1 to set the loop gain. The positive supply voltage terminal of the error amplifier circuit 302*a* is coupled to the source S1 of PMOS device 304 with a source voltage VDD.

A reference voltage VREF is provided on the inverting terminal 324 of the error amplifier circuit 302*b*. The source S2 of PMOS device 305 is coupled to node VINT from first stage voltage regulator circuit 301*a*. The output voltage from the error amplifier circuit 302*b* is denoted as $Vout_2$. A feedback loop 310*b* of second stage voltage regulator circuit 301*b* extends from node VREG at the drain D2 of PMOS device 305 to the non-inverting terminal 326 of error amplifier circuit 302*b*. The positive supply voltage terminal of the error amplifier circuit 302*b* is coupled to node VINT. The loop gain is set to unity, as node VREG will track the DC voltage present at VREF (VREG=VREF).

As mentioned previously, first stage voltage regulator circuit 301*a* is a wide bandwidth stage. Assuming a one-stage error amplifier circuit, gain (Ao1) for the output device of first stage 301*a* is defined according to equation (1):

$$Ao1 := gmo1 \cdot \left( ro1 \cdot \frac{\frac{1}{gmo2}}{ro1 + \frac{1}{gmo2}} \right) \tag{1}$$

where gmo1, gmo2, and ro1 are defined as the transconductance of PMOS devices 304 and 305, and the output impedance of first stage voltage regulator circuit 301*a* respectively. Exemplary values are provided in Table 1 below.

Figure 3:
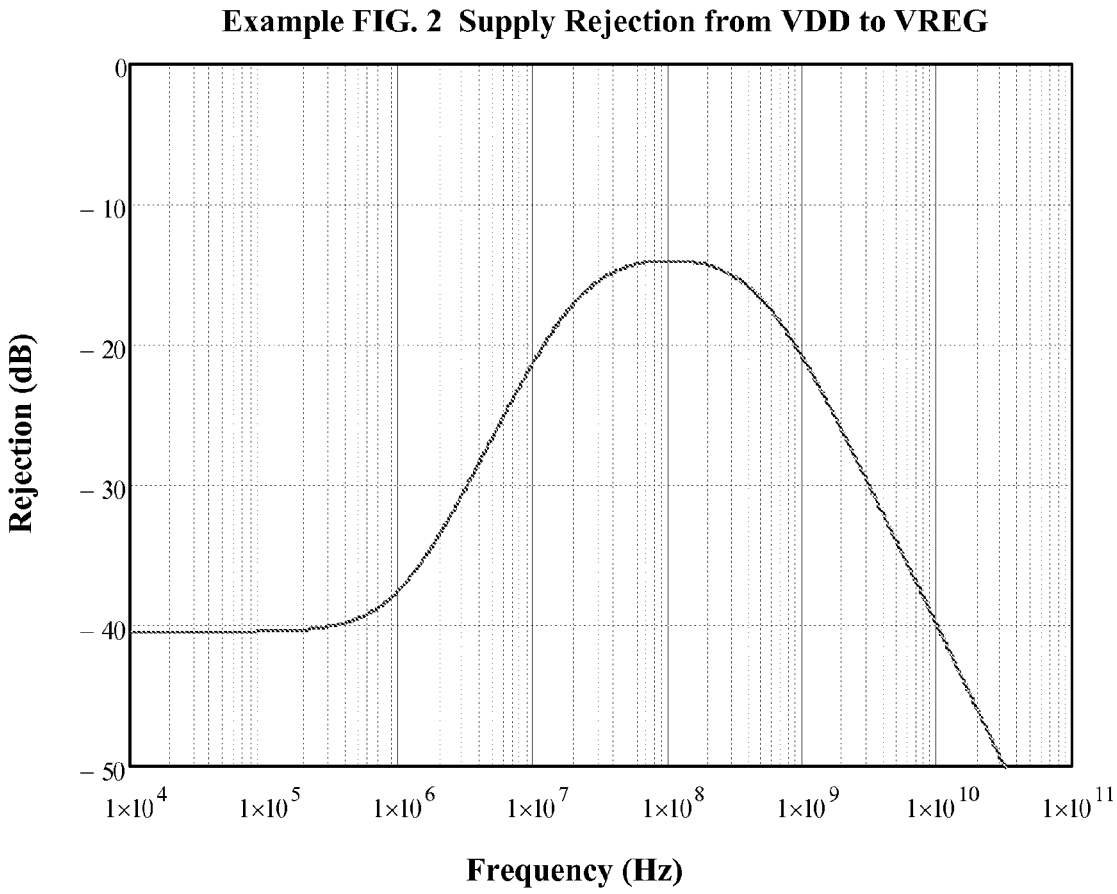
FIG. 3 Prior Art
FIG. 3 is an example graph of the wide bandwidth supply rejection from VDD (input) to VREG (output) vs. Frequency (Hz) for the single-stage LDO voltage regulator shown in FIG. 2.

At the drain D1 of PMOS device 304 and specifically, node VINT, a non-dominant pole is formed. The transfer function between VDD and the intermediate voltage node VINT has a pole frequency (ωo1) defined as according to equation (2):

$$\omega o1(ro1, gmo2, Co1) := \frac{1}{\frac{ro1 \cdot \left(\frac{1}{gmo2}\right) \cdot Co1}{ro1 + \frac{1}{gmo2}}} \tag{2}$$

where Co1, gmo2, and ro1 are defined as the capacitance at VINT node in FIG. 3, the transconductance of PMOS devices 305 and the output impedance of first stage voltage regulator circuit 301*a* respectively. Exemplary values are provided in Table 1 below.

The output node of error amplifier circuit 302*a* forms the dominant pole. The error amplifier circuit 302*a* pole frequency (ωa1) is defined as according to equation (3):

$$\omega a1(ra1, Ca1) := \frac{1}{ra1 \cdot Ca1} \tag{3}$$

where ra1, and Ca1 are defined as the output impedance of error amplifier circuit 302*a*, and the effective output capacitance at error amplifier circuit 302*a*, respectively. Exemplary values are provided in Table 1 below.

The DC supply rejection (Svint_Vdd) at node VINT node is defined according to equation (4):

$$\text{Svint_vdd}(gmo2, ro1) := \frac{\frac{1}{gmo2}}{ro1 + \left(\frac{1}{gmo2}\right)} \tag{4}$$

where gmo2 and ro1 are defined as the transconductance of PMOS device 305, and the output impedance of first stage voltage regulator circuit 301*a*, respectively. Exemplary values are provided in Table 1 below.

The supply to the intermediate voltage VINT node transfer function (Hvint_vdd) is defined according to equation (5):

$$\text{Hvint_vdd}(\text{Svint_vdd}, Aa1, Ao1, \omega a1, \omega o1, s) := \text{Svint_vdd} * \frac{1 + \frac{s}{\omega a1}}{Aa1 * Ao1 + \left(1 + \frac{s}{wo1}\right) * \left(1 + \frac{s}{wa1}\right)} \tag{5}$$

where Svint_vdd is defined in equation (4) above; Aa1 is the open-loop amplifier gain of first stage voltage regulator circuit 301*a*; Ao1 is the gain of the first stage output PMOS device 304 calculated in equation (1); ωo1 is the pole frequency of equation (2) in radians/sec; ωa1 is the error amplifier circuit 302*a* pole frequency in radians/sec according to equation (3) above; and s is a variable corresponding to frequency jω in radians/sec. Exemplary values are provided in Table 1 below.

The open-loop gain function (Holoop1) for first stage voltage regulator circuit 301*a* is defined according to equation (6):

$$Holoop1(Aa1, Ao1, \omega a1, \omega o1, s) := \frac{Aa1 \cdot Ao1}{\left(1 + \frac{s}{\omega o1}\right) \cdot \left(1 + \frac{s}{\omega a1}\right)} \tag{6}$$

where Aa1 is the open-loop amplifier gain of the first stage voltage regulator circuit 301*a*; Ao1 is the loop gain of the first stage voltage regulator circuit 301*a* calculated in equation (1); ωo1 is the pole frequency of equation (2) in radians/sec; ωa1 is the error amplifier circuit 302*a* pole frequency in radians/sec according to equation (3) above; and s is a variable corresponding to frequency jω in radians/sec. Exemplary values are provided in Table 1 below. Similar expressions are defined below for second stage voltage regulator circuit 301*b*. Second stage voltage regulator circuit 301*b* is a narrow-band stage. The output gain (Ao2) at PMOS device 305 is defined according to equation (7):

$$Ao2 := gmo2 \cdot \left( ro2 \cdot \frac{rload}{ro2 + rload} \right) \tag{7}$$

where gmo2, ro2, and rload are defined as the transconductance of PMOS device 305, the output impedance of second stage voltage regulator circuit 301*b*, and the load resistance RL within output load 306, respectively. Exemplary values are provided in Table 1 below.

Node VREG forms the dominant pole. The VREG pole frequency (ωo2) is defined below according to equation (8):

$$\omega o2\begin{pmatrix} ro1, \\ ro2, rload \\ Cd \end{pmatrix} := \frac{1}{\frac{ro2 \cdot rload \cdot Cd}{ro2 + rload}} \tag{8}$$

where ro2, rload, and CL are defined as the output impedance of second stage voltage regulator circuit 301*b*, the load resistance RL, and CL within output load 306 respectively. Exemplary values are provided in Table 1 below.

The second-stage error amplifier circuit 302*b* pole forms the non-dominant pole. The non-dominate pole frequency (ωa2) is defined below according to equation (9):

$$\omega a2(ra2, Ca2) := \frac{1}{ra2 \cdot Ca2} \tag{9}$$

where ra2 and Ca2 are the resistance and capacitance at the output of the second stage error amplifier circuit 302*b*, respectively. Exemplary values are provided in Table 1 below.

DC rejection Svreg_vdd from VDD to the VREG node is defined according to equation (10):

$$\text{Svreg_vdd}(rload, ro2) := \frac{rload}{rload + ro2} \tag{10}$$

where ro2 and rload are defined as the output impedance of second stage voltage regulator circuit 301*b* and the load resistance RL within output load 306, respectively. Exemplary values are provided in Table 1 below.

The AC transfer function from VINT to the VREG node (Hvreg_vint) is defined according to equation (11):

$$\text{Hvreg_vint}(\text{Svreg_vint}, Aa2, Ao2, \omega a2, \omega o2, s) := \text{Sveg_vint} * \frac{1 + \frac{s}{\omega a2}}{Aa2 * Ao2 + \left(1 + \frac{s}{wo2}\right) * \left(1 + \frac{s}{wa2}\right)} \tag{11}$$

where Svreg_vint is the DC rejection according to equation (10) above; Aa2 is the open-loop amplifier gain of second stage voltage regulator circuit 301*b*; Ao2 is the loop gain of second stage voltage regulator circuit 301*b* calculated in equation (7); ωo2 is the pole frequency of equation (8) in radians/sec; ωa2 is the error amplifier circuit 302*b* pole frequency in radians/sec according to equation (9) above; and s is a variable corresponding to frequency jω in radians/sec. Exemplary values are provided in Table 1 below.

Open-loop gain function of second stage voltage regulator circuit 301*b* is defined below according to equation (12)

$$Holoop2(Aa2, Ao2, \omega a2, \omega o2, s) := \frac{Aa2 \cdot Ao2}{\left(1 + \frac{s}{\omega o2}\right) \cdot \left(1 + \frac{s}{\omega a2}\right)} \tag{12}$$

where Aa2 is the open-loop amplifier gain of second stage voltage regulator circuit 301*b*; Ao2 is the gain of PMOS device 305 in second stage voltage regulator circuit 301*b* calculated in equation (7); ωo2 is the pole frequency of equation (8) in radians/sec; ωa2 is the error amplifier circuit 302*b* pole frequency in radians/sec according to equation (9) above; and s is a variable corresponding to frequency jω in radians/sec. Exemplary values are provided in Table 1 below.

The AC transfer function from VDD to the VREG node (Hvreg_vdd) is defined according to equation (13):

$$Hvreg_vdd := Hvint_vdd \cdot Hvreg_vint \tag{13}$$

where Hvint_vdd is the AC transfer function from VDD to node VINT according to equation (5) above and Hvreg_vint is the AC transfer function from VINT to node VREG according to equation (11) above. Exemplary values are provided in Table 1 below.

Example small-signal parameters for error amplifier circuits 302*a* and 302*b* as well as PMOS devices 304 and 305 are defined below. First-stage voltage regulator circuit 301*a* is a wide bandwidth loop with a dominant pole at the error amplifier circuit 302*a* output and a non-dominant pole at the output (drain D1) of PMOS device 304. Other values are possible depending on the integrated circuit process selected (affecting error amplifier parameters), PMOS device size (transconductance, voltage drop, and drain capacitance), in addition to the load capacitance (CL) and load resistance changes.

TABLE 1

Example Device Parameters for FIG. 4

| Component | Value |
|---|---|
| Aa1 | 10 |
| R2/R1 | 1.4/1.1 = 1.27 |
| (VDD = 1.8 V, VINT = 1.4 V, & VREF = 1.1 V) | |
| Aa2 | 2 |
| ra1 | 10 kohm |
| ra2 | 5 kohm |
| ro1, ro2 | 1 kohm |
| gmo1, gmo2 | 10 mA/V |
| Co1 | 1 pf |
| Ca1, Ca2 | 0.5 pF |
| CL | 80 pF |
| rload (RL) | 2 kohm |

Figure 5:
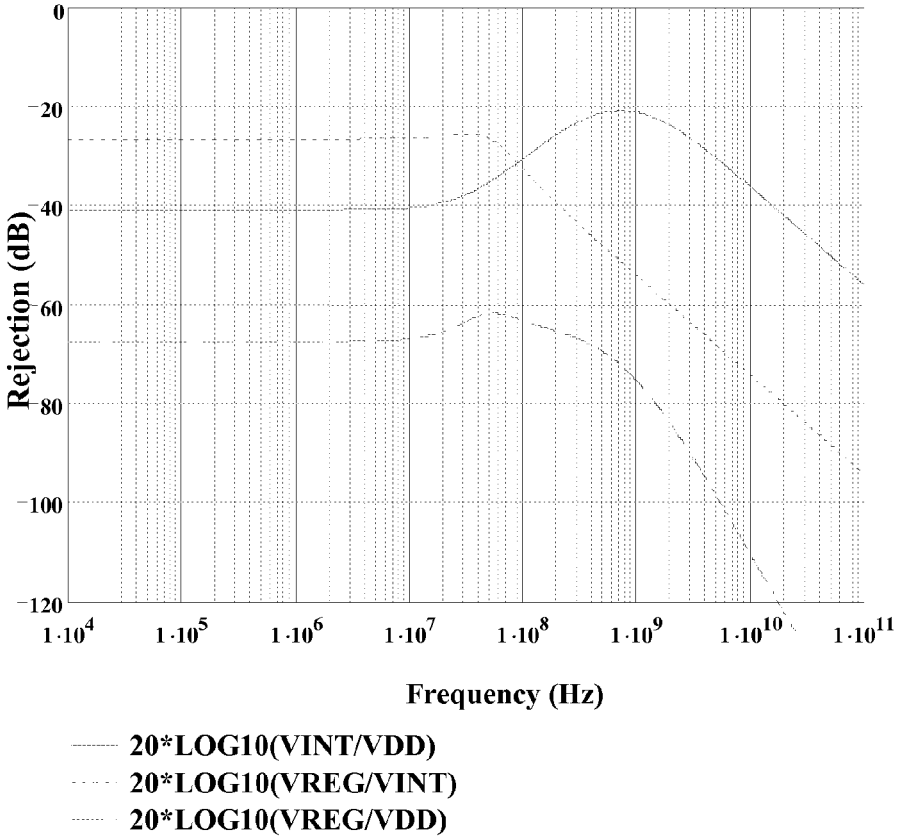
FIG. 5 is an example graph of supply rejection for the transfer functions between VDD to VINT, VINT to VREG, and VDD to VREG vs. Frequency (Hz) for the LDO voltage regulator shown in FIG. 4.

FIG. 5 is an example graph of a supply rejection for the transfer functions from VDD to VINT (Hvint_vdd), VINT to VREG (Hvreg_vint) and VDD to VREG (Hvreg_vdd) vs. Frequency (Hz). In FIG. 5, the graph of the transfer function 20*LOG 10(VINT/VDD) (transfer function from VDD to VINT) is represented as a solid line. The graph of the transfer function 20*LOG 10(VREG/VINT) (transfer function from VINT to VREG) is represented as a dotted line. The graph of the transfer function 20*LOG 10(VREG/VDD) (transfer function from VDD to VREG) is represented as a dashed line. The VDD to VREG transfer function is from the input of first stage voltage regulator circuit 301*a* to the final output of second stage voltage regulator circuit 301*b* vs. Frequency (Hz).

Figure 6:
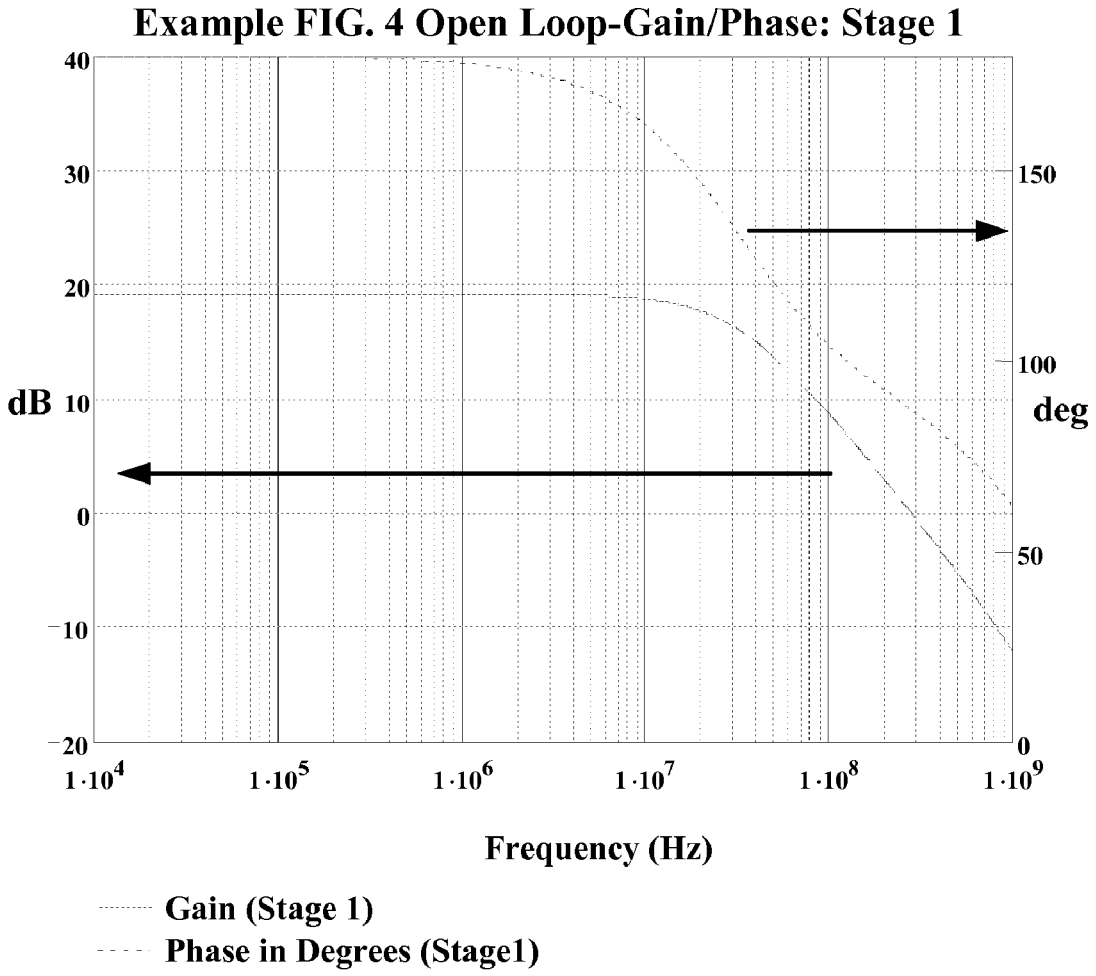
FIG. 6 is an example graph of stage 1 open-loop gain and open-loop phase vs. Frequency (Hz) for the first LDO stage (stage 1) of the LDO voltage regulator shown in FIG. 4.

FIG. 6 is an example graph of a first stage voltage regulator circuit 301*a* open-loop gain and open-loop phase vs. Frequency (Hz). The graph of the loop-gain is shown as a solid line and there is an arrow pointing to the appropriate vertical dB axis. The graph of the phase in degrees is shown as a dotted line and there is an arrow pointing to the appropriate vertical degrees axis.

Figure 7:
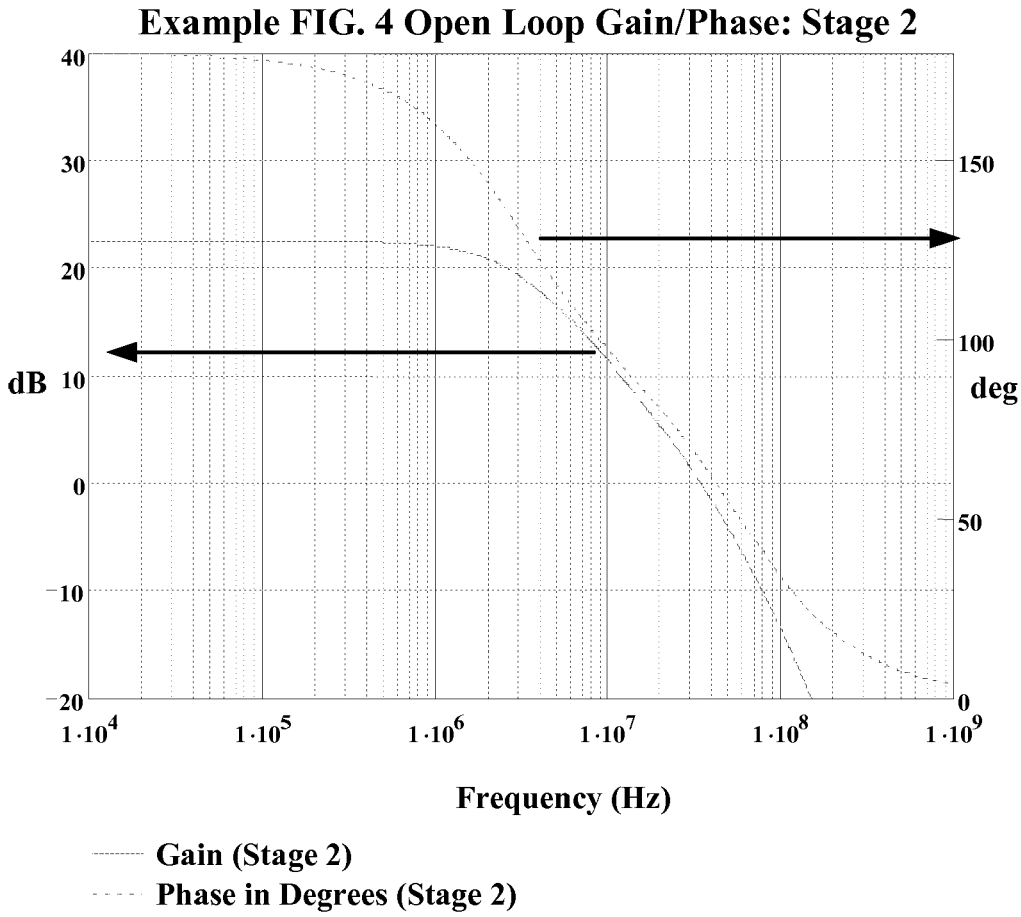
FIG. 7 is an example graph of stage 2 open-loop gain and open loop phase vs. Frequency (Hz) for the second LDO stage (stage 2) of the LDO voltage regulator shown in FIG. 4.

FIG. 7 is an example graph of a second stage voltage regulator circuit 301*b* open-loop gain and open-loop phase vs. Frequency (Hz). The graph of the loop-gain is shown as a solid line and there is an arrow pointing to the appropriate vertical dB axis. The graph of the phase in degrees is shown as a dotted line and there is an arrow pointing to the appropriate vertical degrees axis.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A low drop-out (LDO) voltage regulator comprising:

a first stage voltage regulator circuit the output of which is at an intermediate voltage VINT between an input supply voltage VDD and a final regulated voltage VREG;

a second stage voltage regulator circuit, the output node of which is at the final regulated voltage VREG; and wherein the first stage voltage regulator circuit is configured to have a power supply rejection function that has a zero at a frequency that is greater than or equal to a frequency of a dominant pole of a power supply rejection function of the second stage regulator circuit; and wherein the power supply rejection function of each one of the respective first voltage regulator circuit and second voltage regulator circuit comprises a ratio of a change in the output voltage and a change in the input voltage of the respective voltage regulator circuit.

2. The LDO voltage regulator of claim 1, further comprising a load connected to the output node of the second stage voltage regulator circuit.

3. The LDO voltage regulator of claim 2, wherein the first stage voltage regulator circuit, second stage voltage regulator circuit and load operate to align the dominant zero frequency of the first stage voltage regulator circuit and the dominant pole frequency of the second stage voltage regulator circuit to reduce a magnitude of an AC transfer function from the input providing the input supply voltage VDD to the output node across a range of frequencies.

4. The LDO voltage regulator of claim 1, wherein the first stage voltage regulator circuit includes a first stage error amplifier circuit the gain for which is set by a feedback path from the output node of the first stage voltage regulator circuit to a positive input of the first stage error amplifier circuit.

5. The LDO voltage regulator of claim 4, wherein the first stage error amplifier circuit compares the feedback from the output node and a reference voltage connected to the negative input of the first stage error amplifier circuit.

6. The LDO voltage regulator of claim 5, wherein the first stage error amplifier circuit output is connected to the gate input of a first stage PMOS device, the source of the first stage PMOS device is connected to the input providing the input supply voltage VDD, and the drain of the first stage PMOS device is connected to the output node of the first stage voltage regulator circuit.

7. The LDO voltage regulator of claim 4, wherein the second stage voltage regulator circuit includes a second stage error amplifier circuit the gain for which is set by a feedback path from the output voltage VREG to the positive input of the second stage error amplifier circuit.

8. The LDO voltage regulator circuit of claim 7, wherein the second stage error amplifier circuit compares the feedback from the input providing the output voltage VREG and a reference voltage connected to the negative input of the second stage error amplifier circuit.

9. The LDO voltage regulator circuit of claim 8, wherein the second stage error amplifier circuit is connected to the gate input of a second stage PMOS device, the source of the second stage PMOS device is connected to the output node of the first stage voltage regulator circuit, and the drain of the second stage PMOS device is connected to the output node of the second stage voltage regulator circuit.

10. The LDO voltage regulator circuit of claim 9, wherein the gain of the first stage error amplifier circuit is set by a feedback path composed of a first resistive divider.

11. The LDO voltage regulator circuit of claim 9, wherein the first stage error amplifier circuit positive supply voltage is connected to the input supply voltage VDD.

12. The LDO voltage regulator circuit of claim 11, wherein the second stage error amplifier circuit positive supply voltage is connected to the to the output node of the first stage voltage regulator circuit.

13. The LDO voltage regulator circuit of claim 1, wherein the dominant zero frequency of the first stage voltage regulator circuit is formed by a capacitor connected between the gate and the drain of a first stage PMOS device;

wherein a first terminal of the capacitor is connected to an output of an amplifier circuit of the first stage voltage regulator circuit; and wherein a second terminal of the capacitor is connected to an inverting input of the amplifier circuit of the first stage voltage regulator circuit.

14. The LDO voltage regulator circuit of claim 13, wherein the dominant pole frequency of the second stage voltage regulator circuit is formed by the combination of the output resistance, load resistance and load capacitance of the second stage voltage regulator circuit at the output node of the second stage voltage regulator circuit.

15. The low drop-out (LDO) voltage regulator of claim 1, wherein the power supply rejection function of the first stage voltage regulator circuit comprises a ratio of change between a change in the VINT and a change in the VDD; and wherein the power supply rejection function of the second stage voltage regulator circuit comprises a ratio of change between a change in the VREG and a change in the VINT.

16. An integrated circuit (IC) including a low drop-out (LDO) voltage regulator comprising:

a first stage voltage regulator circuit the output of which is at an intermediate voltage VINT between an input supply voltage VDD and a final regulated voltage VREG;

a second stage voltage regulator circuit, the output node of which is at the final regulated voltage VREG; and wherein the first stage voltage regulator circuit is configured to have a power supply rejection function that a zero at a frequency that is greater than or equal to a frequency of a dominant pole of a power supply rejection function of the second stage regulator circuit: and wherein the power supply rejection function of each one of the respective first voltage regulator circuit and second voltage regulator circuit comprises a ratio of a change in the output voltage and a change in the input voltage of the respective voltage regulator circuit.

17. The IC of claim 16, further comprising a load connected to the output node of the second stage voltage regulator circuit.

18. The IC of claim 17, wherein the first stage voltage regulator circuit, second stage voltage regulator circuit and load operate to align the dominant zero frequency of the first stage voltage regulator circuit and the dominant pole frequency of the second stage voltage regulator circuit to reduce a magnitude of an AC transfer function from the input providing the input supply voltage VDD to the output node across a range of frequencies.

19. The IC of claim 18, wherein the first stage voltage regulator circuit includes a first stage error amplifier circuit the gain for which is set by a feedback path from the output node of the first stage voltage regulator circuit to a positive input of the first stage error amplifier circuit.

20. The IC of claim 19, wherein the second stage voltage regulator circuit includes a second stage error amplifier circuit the gain for which is set by a feedback path from the output node of the second stage voltage regulator circuit to a positive input of the second stage error amplifier circuit.

21. The IC of claim 16, wherein the dominant zero frequency of the first stage voltage regulator circuit is formed by a capacitor connected between the gate and the drain of a first stage PMOS device;

wherein a first terminal of the capacitor is connected to an output of an amplifier circuit of the first stage voltage regulator circuit; and wherein a second terminal of the capacitor is connected to an inverting input of the amplifier circuit of the first stage voltage regulator circuit.

22. The IC of claim 21, wherein the dominant pole frequency of the second stage voltage regulator circuit is formed by the combination of the output resistance, load resistance and load capacitance of the second stage voltage regulator circuit at the output node of the second stage voltage regulator circuit.

23. The IC of claim 16, wherein the power supply rejection function of the first stage voltage regulator circuit comprises a ratio of a change in the VINT and a change in the VDD; and wherein the power supply rejection function of the second stage voltage regulator circuit comprises a ratio of a change in the VREG and a change in the VINT.

24. A device including a low drop-out (LDO) voltage regulator comprising:

first stage voltage regulator means for generating at an output node thereof an intermediate voltage VINT between an input supply voltage VDD and a final regulated voltage VREG;

second stage voltage regulator means for generating at an output node thereof the final regulated voltage VREG; and wherein the first stage voltage regulator circuit is configured to have a power supply rejection function that has a zero at a frequency that is greater than or equal to a frequency of a dominant pole of a power supply rejection function of the second stage regulator circuit; and wherein the power supply rejection function of each one of the respective first voltage regulator circuit and second voltage regulator circuit comprises a ratio of a change in the output voltage and a change in the input voltage of the respective voltage regulator circuit.

25. The device of claim 24, further comprising a load connected to the output node of the second stage voltage regulator means.

26. The device of claim 25, wherein the first stage voltage regulator means, second stage voltage regulator means and load operate to align the dominant zero frequency of the first stage voltage regulator means and the dominant pole frequency of the second stage voltage regulator means to reduce a magnitude of an AC transfer function from the input providing the input supply voltage VDD to the output node across a range of frequencies.

27. The device of claim 24, wherein the first stage voltage regulator circuit includes first stage error amplifier means the gain for which is set by a feedback path from the output node of the first stage voltage regulator means to a positive input of the first stage error amplifier means.

28. The device of claim 27, wherein the second stage voltage regulator means includes second stage error amplifier means the gain for which is set by a feedback path from the output node of the second stage voltage regulator circuit to a positive input of the second stage error amplifier circuit.

29. The device of claim 28, wherein the gain of the first stage error amplifier means is set by a feedback path composed of a first resistive divider.

30. The device of claim 24, wherein the dominant zero frequency of the first stage voltage regulator means is formed by a capacitor connected between the gate and the drain of a first stage PMOS device;

wherein a first terminal of the capacitor is connected to an output of an amplifier circuit of the first stage voltage regulator circuit; and wherein a second terminal of the capacitor is connected to an inverting input of the amplifier circuit of the first stage voltage regulator circuit.

31. The device of claim 24, wherein the dominant pole frequency of the second stage voltage regulator means is formed by the combination of the output resistance, load resistance and load capacitance of the second stage voltage regulator means at the output node of the second stage voltage regulator means.

32. The device of claim 24, wherein the device is an integrated circuit.

33. The device of claim 24, wherein the device is at least one of a cellular phone, a wireless communication device, a radio frequency transmitter device, a radio frequency receiver device, a radio frequency transceiver device and a wireless handset.

34. The device of claim 24, wherein the power supply rejection function of the first stage voltage regulator circuit comprises a ratio of a change in the VINT and a change in the VDD; and wherein the power supply rejection function of the second stage voltage regulator circuit comprises a ratio of a change in the VREG and a change in the VINT.

35. A method for regulating a voltage comprising:

generating a first stage voltage regulator circuit with an intermediate voltage VINT between an input supply voltage VDD and a final regulated voltage VREG, the first stage voltage regulator circuit;

generating a second stage voltage regulator circuit with a final regulated voltage VREG, the second stage voltage regulator circuit;

wherein the first stage voltage regulator circuit is configured to have a power supply rejection function that has a zero at a frequency that is greater than or equal to a frequency of a dominant pole of a power supply rejection function of the second stage regulator circuit; and wherein the power supply rejection function of each one of the respective first voltage regulator circuit and second voltage regulator circuit comprises a ratio of a change in the output voltage and a change in the input voltage of the respective voltage regulator circuit.

36. The method of claim 35, further comprising aligning the dominant zero frequency of the first stage voltage regulator and the dominant pole frequency of the second stage voltage regulator to reduce a magnitude of an AC transfer function from the input providing the input supply voltage VDD to the output node across a range of frequencies.

37. The method of claim 35, wherein the power supply rejection function of the first stage voltage regulator circuit comprises a ratio of a change in the VINT and a change in the VDD; and wherein the power supply rejection function of the second stage voltage regulator circuit comprises a ratio of a change in the VREG and a change in the VINT.

38. An apparatus, comprising:

a first stage voltage circuit that exhibits a power supply rejection function that is configured to have a zero at a frequency that is greater than or equal to a frequency of a dominant pole of a power supply rejection function of a second stage voltage regulator circuit that is receives an input voltage from the first stage voltage circuit; and wherein the power supply rejection function of each one of the respective first voltage regulator circuit and second voltage regulator circuit comprises a ratio of a change in the output voltage and a change in the input voltage of the respective voltage regulator circuit.

39. The apparatus of claim 38, wherein the zero frequency of the first stage voltage regulator occurs is equal to the dominant pole frequency of the second stage voltage regulator circuit.

40. The apparatus of claim 38, wherein the power supply rejection function of the first stage voltage regulator circuit comprises a ratio of a change in an intermediate voltage VINT and a change in an input supply voltage VDD; and wherein the power supply rejection function of the second stage voltage regulator circuit comprises a ratio of a change in a final regulated voltage VREG and a change in the input supply voltage VINT.

* * * * *